US007354239B2

(12) United States Patent
Deyo et al.

(10) Patent No.: US 7,354,239 B2
(45) Date of Patent: Apr. 8, 2008

(54) ATTACHMENT DEVICE FOR A LOADER BUCKET OR FORK

(75) Inventors: Charles E. Deyo, Lisbon, ND (US); Wally L. Kaczmarski, Lisbon, ND (US); Corwin E. Waswick, Gwinner, ND (US); Verne C. Watts, Lisbon, ND (US)

(73) Assignee: Clark Equipment Company, West Fargo, ND (US)

( * ) Notice: Subject to any disclaimer, the term of this patent is extended or adjusted under 35 U.S.C. 154(b) by 0 days.

(21) Appl. No.: 11/021,316

(22) Filed: Dec. 23, 2004

(65) Prior Publication Data

US 2006/0182600 A1 Aug. 17, 2006

(51) Int. Cl.
*E02F 9/00* (2006.01)

(52) U.S. Cl. ..... 414/724; 37/406; 414/912

(58) Field of Classification Search ..... 414/724, 414/729, 739, 912; 37/406
See application file for complete search history.

(56) References Cited

U.S. PATENT DOCUMENTS

| | | | | |
|---|---|---|---|---|
| 2,774,155 | A | 12/1956 | Hipp | 37/145 |
| 3,700,131 | A | 10/1972 | Westendorf | |
| 4,285,628 | A | 8/1981 | Jankowski | 414/739 |
| 4,372,063 | A | 2/1983 | Work | 37/2 R |
| 4,925,359 | A | 5/1990 | Dunnegan | 414/722 |
| 5,639,205 | A * | 6/1997 | Kaczmarczyk et al. | 414/723 |
| 6,074,160 | A | 6/2000 | Brumbaugh et al. | 414/704 |
| 6,357,993 | B1 | 3/2002 | Burton | 414/724 |
| 6,453,586 | B1 | 9/2002 | Wolin et al. | 37/406 |
| 6,589,007 | B2 | 7/2003 | Burton | 414/724 |
| 2002/0044862 | A1 | 4/2002 | Burton | 414/724 |
| 2002/0053150 | A1 | 5/2002 | Burton | 37/406 |
| 2002/0192065 | A1 * | 12/2002 | Underwood | 414/729 |
| 2004/0253089 | A1 * | 12/2004 | Atencio | 414/724 |

OTHER PUBLICATIONS

European/Int'l Search Report for application No. PCT/US/2005/044467, filed Dec. 8, 2005, 3 pages, authored by O. Verheul on Apr. 19, 2006.

* cited by examiner

*Primary Examiner*—Donald Underwood
(74) *Attorney, Agent, or Firm*—Westman, Champlin & Kelly, P.A.

(57) ABSTRACT

A mounting device for securing a grapple tooth bar to a loader bucket or fork includes at least one guide arm rotatably secured to the loader bucket or fork and having a distal end. A grapple tooth bar mounting bracket is attached to the distal end of the guide arm where the grapple tooth bar positions within the grapple tooth bar mounting bracket. The grapple tooth bar is removably secured to the grapple tooth bar mounting bracket with at least one securing mechanism such that mounting device can be mounted to loader buckets or forks of varying widths and can accept grapple tooth bars of various lengths.

20 Claims, 6 Drawing Sheets

ATTACHMENT DEVICE FOR A LOADER BUCKET OR FORK

BACKGROUND OF THE INVENTION

The present invention relates to a mounting device for a loader bucket or fork. More particularly, the present invention relates to a mounting device for removably attaching one of a plurality of grapple bars of varying lengths to a loader bucket or fork.

Many grapples are specifically designed to attach to a specific loader bucket or fork of various widths. Because the grapple is designed to attach with a specific loader bucket or fork, any variation in width or design of the loader bucket or fork requires that the grapple be revised for the width change. Having to redesign the grapple and produce numerous non-interchangable parts adds manufacturing expenses and therefore raises the purchase price of loader buckets or forks with grapples.

SUMMARY OF THE INVENTION

The present invention includes a mounting device that secures a grapple tooth bar to a loader bucket or fork. The mounting device includes at least one guide arm rotatably secured to the loader bucket and has a distal end. A grapple tooth bar mounting bracket is attached to the distal end of the guide arm where the grapple tooth bar positions within the grapple tooth bar mounting bracket. The grapple tooth bar is removably secured to the grapple tooth bar mounting bracket with at least one securing mechanism such that mounting device can be mounted to loader buckets or forks of varying widths and can accept grapple tooth bars of various lengths.

DETAILED DESCRIPTION OF THE PREFERRED EMBODIMENTS

Figure 1:
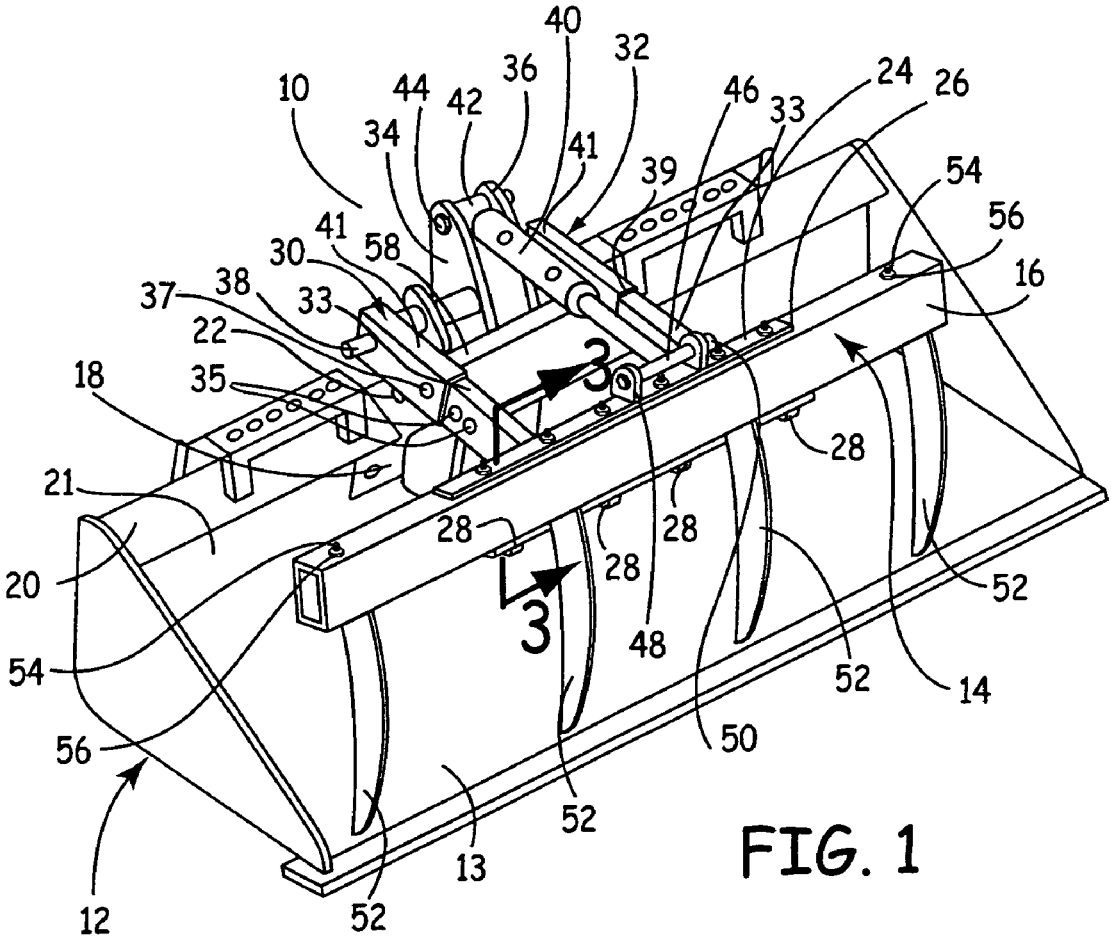
FIG. 1 is a perspective view of a mounting device of the present invention for attaching a grapple to a loader bucket.
Figure 2:
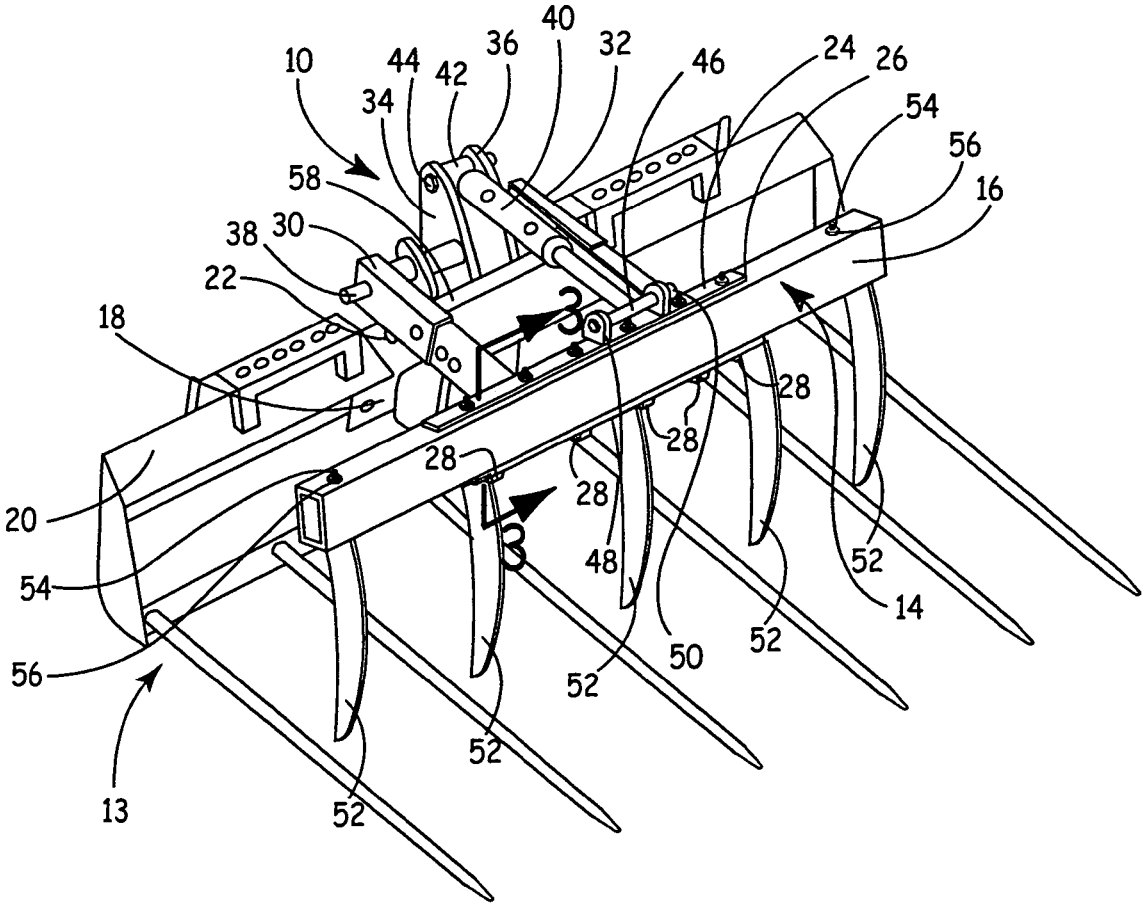
FIG. 2 is a perspective view of a mounting device of the present invention for attaching a grapple to a fork.

A mounting device is generally illustrated in FIG. 1 at 10. The mounting device 10 is designed to secure a grapple 14 to a loader bucket 12. Referring to FIG. 2, the mounting device can also secure the grapple 14 to a fork 13.

The mounting device 10 can be attached to loader buckets 12 or forks of varying widths and designs and accepts a grapple tooth bar 16 of varying lengths that span across a selected width of the loader bucket 12 or fork. It is also within the scope of the present invention to mount other implements to a loader bucket or fork with the mounting device 10.

Referring to FIGS. 1 and 2, the mounting device 10 includes a base plate 18 that is attached to an upper rail 20 and a back 21 of the loader bucket 12 or fork. The base plate 18 generally conforms to a configuration of the upper rail 20 and the back 21, and is preferably attached to the upper rail 20 and the back 21 with a plurality of bolts 22 that are threadably engaged with threaded nuts (not shown). The base plate 18 can also be attached by any other suitable attaching mechanism including, but not limited to, rivets and a weld.

Figure 3:
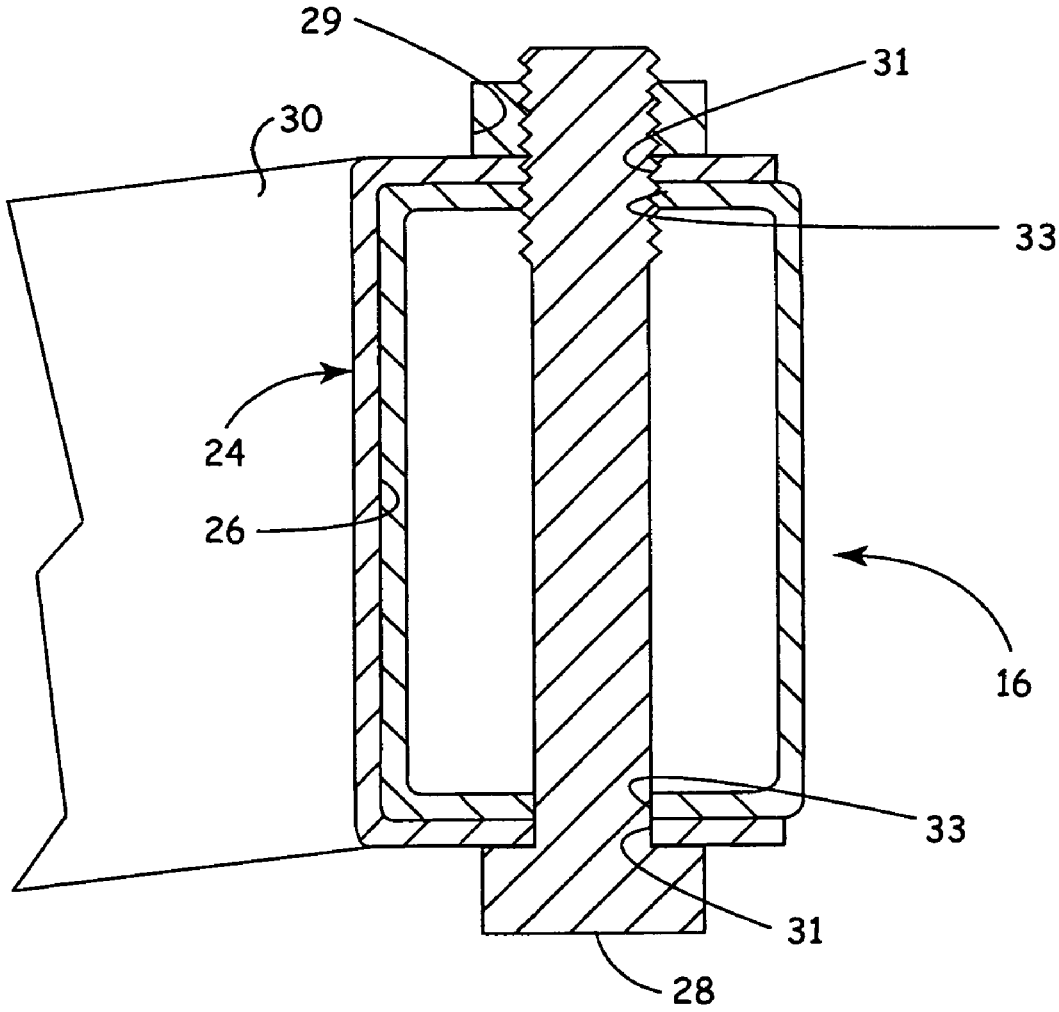
FIG. 3 is a sectional view along section line 3-3 in FIGS. 1 and 2.

Referring to FIGS. 1-3, the grapple tooth bar 16 is positioned within a generally U-shaped channel 26 of a grapple tooth bar mounting bracket 24. The grapple tooth bar 16 is detachably secured to the grapple tooth bar mounting bracket 24. A plurality of apertures 31 in the grapple tooth bar mounting bracket 26 are aligned with a plurality of apertures 33 in the grapple tooth bar 16 such that a plurality of bolts 28 are position therethrough and secured with a threadable engagement with a plurality of threaded nuts 29.

The threadable engagement of the nuts 29 with the bolts 28 allows one grapple tooth bar 16 to be replaced with another grapple tooth bar 16 having a different length by removing the nuts 29 from the bolt 28 and removing the bolts 28 from the aligned apertures 31, 33. With the first grapple tooth bar 16 removed from the grapple tooth bar mounting bracket 24, another grapple tooth bar 16 is positioned within the U-shaped channel 26 such that the apertures 31, 33 are aligned. With the apertures 31, 33 aligned, the bolts 28 are positioned therethrough and secured with the threadable engagement with the nuts 29.

The grapple tooth bar mounting bracket 24 generally conforms to a generally square or rectangular cross-section of the grapple tooth bar 16. Other configured grapple tooth bar mounting brackets 24 and different cross-section grapple tooth bars are also within the scope of the present invention including, but not limited to, a circular cross-section, an oval cross-section, a polygonal cross-section, and an L-shape or V-shape.

Referring to FIG. 1, left and right guide arms 30, 32, respectively, extend from the grapple tooth bar mounting bracket 24 and toward left and right mounting plates 34, 36, respectively, that extend from the base plate 18. The left and right guide arms 30, 32 are similarly constructed and include a distal portion 33 that slidably telescopes within a channel 39 within a proximal portion 31. One of a plurality of apertures 35 in the distal portion 33 is aligned with an aperture (not shown) in the proximal portion 41 and a pin 37 or a bolt is inserted therethrough to secure the distal portion 33 to the proximal portion. Because the distal portion 33 telescopes within the proximal portion 41, a length of the guide arms 30,32 is adjustable. However, guide arms of a fixed length are also within the scope of the present invention.

The left and right guide arms 30, 32 are non-rotatably secured proximate left and right ends of an axle 38. The axle 38 is rotatably supported by the left and right mounting plates 34, 36 preferably with bearings (not shown) secured within housings (not shown). As the grapple tooth bar mounting bracket 24 and the guide arms 30,32 rotate about an axis of the axle 38, the left and right guide arms 30,32 move in an arcuate path causing the grapple tooth bar 16 to raise and lower.

The grapple tooth bar 16 is preferably raised and lowered with an hydraulic cylinder 40 having a proximal end 42 rotatably mounted between the left and right mounting plates 34, 36 with a pin 44 positioned through aligned apertures (not shown) in the left and right mounting plates 34,36 and a through bore (not shown) proximate the proximal end 42 of the hydraulic cylinder 40. The pin 44 allows the hydraulic cylinder 40 to pivot with respect to the left and right mounting plates 34, 36.

A distal end 46 of the hydraulic cylinder 40 is pivotally attached to mounting brackets 48 extending from the grapple tooth bar mounting bracket 24. A pivot pin 50 is positioned through aligned apertures (not shown) in the mounting brackets 48 and a bore (not shown) proximate the distal end 46 of the hydraulic cylinder 40 to pivotally retain the distal end 46 of the hydraulic cylinder 40 to the grapple tooth bar mounting bracket 24. Although a hydraulic cylinder 40 is a preferred actuating mechanism, other actuating mechanisms are also within the scope of the present invention including, but not limited to, a pneumatic drive or ram and an electric drive or ram.

A plurality of grapple teeth 52 are removably attached to the grapple tooth bar 16. Each of the grapple teeth 52 has a threaded end 54 that is positioned through one of a plurality of through bores in the grapple tooth bar 16. The threaded end 54 is threadably engaged with a threaded nut 56 to secure the grapple tooth 52 to the grapple tooth bar 16. The threaded attachment of the grapple tooth 52 to the grapple tooth bar 26 allows the grapple teeth 52 to be arranged in different configurations as needed for a specific application. Additionally, differently configured grapple teeth 52 can be attached to and removed from the grapple tooth bar 16 as required for the specific application.

Other mechanisms for removably attaching the grapple teeth 52 to the grapple tooth bar 16, in addition to a threadable engagement, are also within the scope of the present invention including but not limited to, a hasp and a camming mechanism. It is also within the scope of the present invention to permanently attach the grapple teeth 52 to the grapple tooth bar 16.

The upward travel of the grapple tooth bar 16 is limited by a formed plate 58 attached to the left and right guide arms 30, 32. As the grapple tooth bar 16 is raised, the formed plate 58 contacts the left and right mounting plates 34, 36 and prevents the grapple tooth bar 16 and the grapple teeth 52 from being further raised, and thereby preventing the actuator/cylinder 40 from going over center as additional force is applied to the grapple 10 in the open state.

Figure 4:
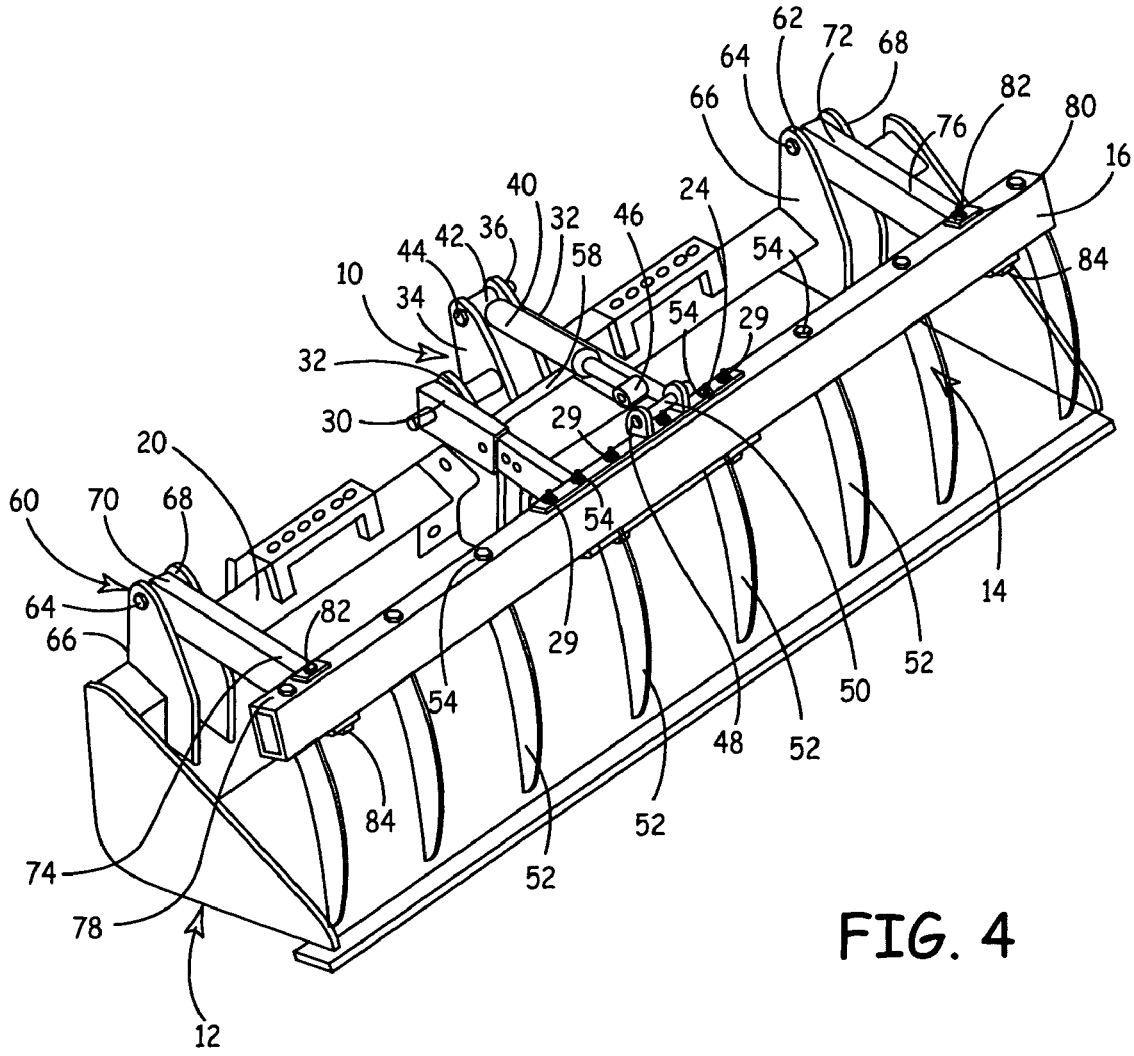
FIG. 4 is a perspective view of the mounting device of the present invention having guide arms attached to ends of the grapple.

Referring to FIG. 4, additional left and right guide arms 60, 62 are optionally attached to the grapple tooth bar 16 proximate the ends of the grapple tooth bar 16 to limit the amount of torque exerted upon the mounting device 10 and the actuator 40. Each of the guide arms 60, 62 are pivotally attached to the top rail 20 of the loader bucket 12 or fork with mounting pins 64 disposed through aligned apertures (not shown) in left and right plates 66, 68 and a bore (not shown) in the proximal ends 70, 72 of the guide arms 60, 62, respectively. Distal ends 74, 76 of the guide arms 60, 62 are attached to brackets 78, 80 having the generally U-shaped channels. The grapple tooth bar 16 is inserted into the generally U-shaped channels and is secured within the brackets 78, 80 with threadable engagements of a plurality of bolts 82 with a plurality of nuts 84.

Figure 5:
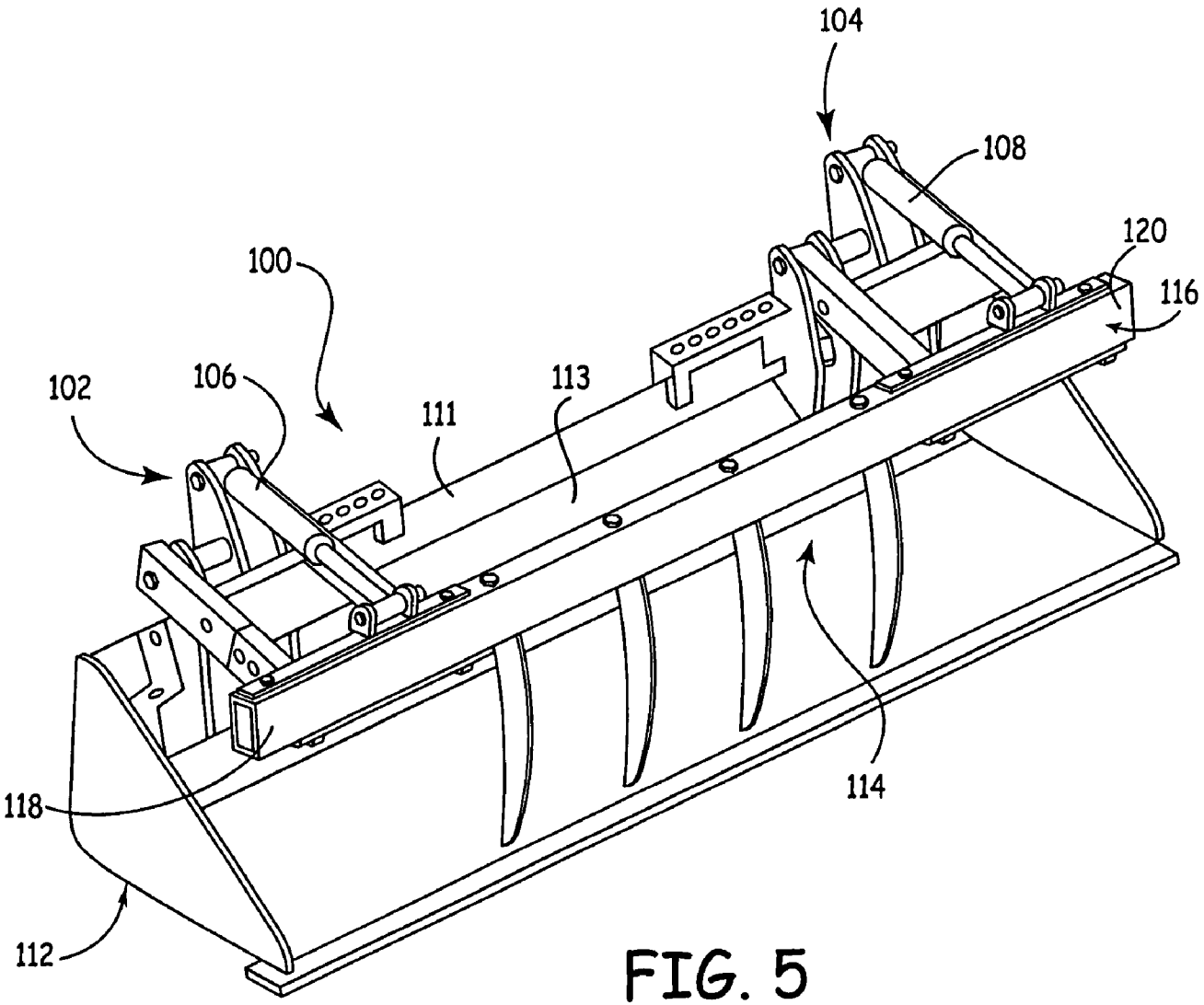
FIG. 5 is a perspective view of an alternative embodiment of the mounting device of the present invention for attaching a grapple to a loader bucket or fork.

Referring to FIG. 5, an alternative configuration for removably securing a grapple 114 to a loader bucket 112 or fork is generally illustrated at 100. The configuration 100 includes a left mounting device 102 and a right mounting device 104 attached to a top rail 111 and a back 113 of the loader bucket 112 or fork.

The left and right mounting devices 102,104 are substantially similar to the mounting device 10 and will not be described in detail. The left and right mounting devices 102,104 could also be mirror images of each other and similar to mounting device 10. However, the configuration 100 of the left mounting device 102 and a right mounting device 104 attached proximate left and right ends 118, 120, respectively, of the grapple tooth bar 116 reduces the amount of torque placed upon a single mounting device and also reduces the need for additional guide arms positioned at the ends of the grapple tooth bar 116.

A left actuator 106 is operably attached to the left mounting device 102 and proximate the left end 118 of the grapple tooth bar 116. A right actuator 108 is operably attached to the right mounting device 104 and also proximate the right end 120 of the grapple tooth bar 116. The actuators 106,108 are preferably operated by a common power source such that the actuators 106,108 operate to raise and lower the grapple tooth bar 116 in unison.

Figure 6:
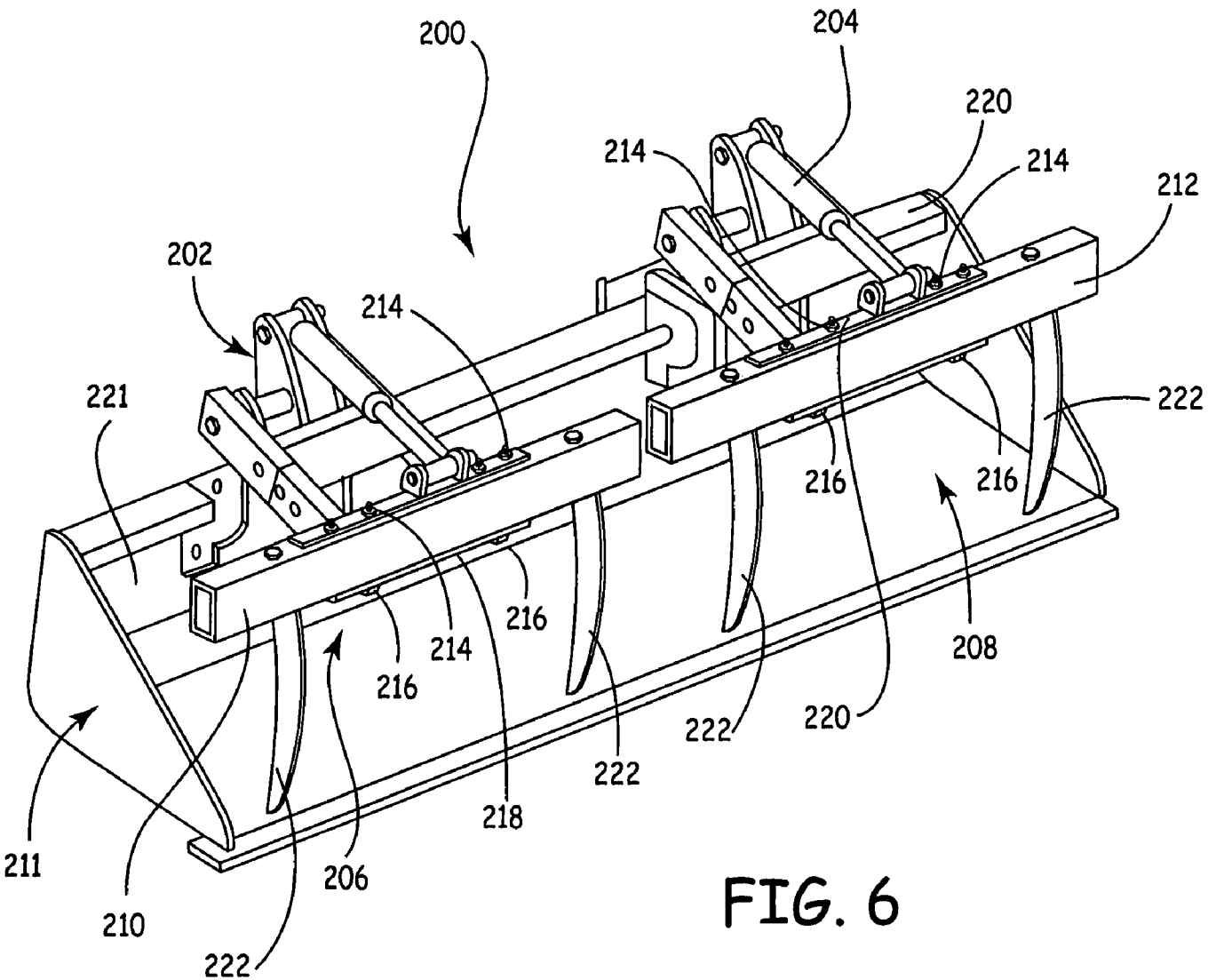
FIG. 6 is a perspective view of another alternative embodiment of the mounting device of the present invention for attaching independently movable grapples to a loader bucket or fork.

Referring to FIG. 6, another alternative configuration of the present invention is generally illustrated at 200. The alternative configuration 200 includes left and right mounting devices 202, 204 attached to the top rail 220 and a back 221 of the loader bucket 211 or fork which independently control left and right grapples 206, 208, respectively. The left and right mounting devices 202, 204 are substantially similar to the mounting device 10 and will not be described in detail.

Actuators 203, 205 can raise and lower the grapples 206, 208, respectively, in unison. However, independent operation of the actuators 203,205 is also within the scope of the present invention.

Left and right grapple tooth bars 210, 212 of the left and right grapples 206, 208 are removably attached to the left and right mounting devices 202, 204, all respectively, as previously described, with a threadable engagement of bolts 214 with nuts 216. The threadable engagement secures the grapple tooth bars 210, 212 within channels in mounting brackets 218, 220 such that the grapple tooth bars 210, 212 can be removed from the mounting devices 202,204, respectively. Additionally, grapple teeth 222 are removably attached to the grapple tooth bars 210,212 with a threadable engagement as previously described such that the configuration of the grapple teeth 212 with either grapple 206, 208 can be modified.

One skilled in the art will recognize that the mounting device 10 of the present invention is capable of being used on different width loader buckets or forks and can secure varying width grapples or other implements to the loader bucket or fork. Additionally, the mounting device 10 can be used in different configurations on the loader bucket or fork to mount a single grapple or two more grapples to the loader bucket or fork. The mounting device 10 is generally the same design for any loader bucket or fork independent the width of the loader bucket or fork, thereby reducing design and manufacturing costs.

Further, because the mounting device is preferably bolted to the loader bucket or fork, the mounting device universally mounts to any loader bucket or fork. Additionally, the length of the grapple can be changed by replacing the grapple tooth bar to span different width loader buckets or forks, thereby reducing the design and production cost for supplying grapples for a variety of loader bucket or fork designs, each of which may have varying widths.

Although the present invention has been described with reference to preferred embodiments, workers skilled in the art will recognize that changes may be made in form and detail without departing from the spirit and scope of the invention.

What is claimed is:

1. A mounting device for securing a grapple tooth bar to a loader bucket or fork, the mounting device comprising:

a first guide arm rotatably attachable to the loader bucket or fork and including a first distal end, the first guide arm further rotatably attachable to loader buckets or forks having different widths;

a second guide arm spaced apart from the first guide arm and including a second distal end, the second guide arm rotatably attachable to the loader bucket or fork, and the second guide arm further rotatably attachable to loader buckets or forks having different widths;

a grapple tooth bar mounting bracket attached to the first distal end of the first guide arm and the second distal end of the second guide arm, the grapple tooth bar mounting bracket defining a channel extending from the first guide arm to the second guide arm;

a grapple tooth bar positionable within the channel in the grapple tooth bar mounting bracket; and at least one securing mechanism for detachably securing the grapple tooth bar to the grapple tooth bar mounting bracket such that the grapple tooth bar is replaceable with grapple tooth bars of different lengths that are detachably securable to the grapple tooth bar mounting bracket within the channel.

2. The mounting device of claim 1, wherein each of the first guide arm and the second guide arm has a length and further includes a proximal portion and a distal portion, the distal portion being extendable into the proximal portion such that the length of the first guide arm and the length of the second guide arm is adiustable.

3. The mounting device of claim 2 and further comprising:

an axle non-rotatably secured to the first and second guide arms, and wherein the axle rotatably attaches to the loader bucket or fork.

4. The mounting device of claim 1 and further comprising an actuator having a first end rotatably securable to the loader bucket or fork and a second end rotatably secured to the grapple tooth bar mounting bracket.

5. The mounting device of claim 4 and wherein the actuator comprises a hydraulic cylinder.

6. The mounting device of claim 2 and further comprising a mounting plate, and a formed plate attached to the first and second guide arms, and wherein the formed plate contacts the mounting plate to limit an upward movement of the grapple tooth bar.

7. The mounting device of claim 1, and wherein the securing mechanism comprises a threadable engagement of a threaded bolt and a nut.

8. A device for a loader bucket or fork comprising:

an actuator having a first end attachable to the loader bucket or fork and a second end;

a grapple tooth bar mounting bracket directly attached to the second end of the actuator; and a grapple tooth bar removably attachable to the grapple tooth bar mounting bracket such that one of a plurality of different length grapple tooth bars are detachably securable to the grapple tooth bar mounting bracket to accommodate loader buckets or forks having different widths.

9. The device of claim 8 and wherein the actuator comprises a hydraulic cylinder.

10. The device of claim 8 and further comprising at least one grapple tooth attached to the grapple tooth bar.

11. The device of claim 8 and wherein the grapple tooth bar includes a plurality of spaced apart apertures.

12. The device of claim 11 and further comprising a plurality of grapple teeth and wherein each of the plurality of grapple teeth is secured in selected positions within the plurality of spaced apart apertures of the grapple tooth bar.

13. The device of claim 8 and further comprising first and second guide arms positioned on opposite sides of the actuator and having first ends attached to the loader bucket or fork and second ends removably attached to the grapple tooth bar mounting bracket.

14. The device of claim 13 and further comprising a plurality of securing mechanisms for securing the grapple tooth bar to the grapple tooth bar mounting bracket.

15. The device of claim 14 and wherein the plurality of securing mechanisms comprises threadable engagements of a plurality of bolts and nuts.

16. The mounting device of claim 1, wherein the channel is an elongated channel and extends laterally beyond the first guide arm and laterally beyond the second guide arm.

17. The mounting device of claim 16, wherein the grapple tooth bar mounting bracket is substantially U-shaped in cross section and configured to receive grapple tooth bars having different lengths.

18. The mounting device of claim 8, wherein the grapple tooth bar mounting bracket includes a channel, and wherein the grapple tooth bar is detachably securable to the grapple tooth bar mounting bracket within the channel, the grapple tooth bar replaceable with another of the plurality of different length grapple tooth bars that is detachably securable to the grapple tooth bar mounting bracket.

19. A mounting device for a loader bucket or fork, the mounting device comprising:

a first guide arm rotatably mountable to the loader bucket or fork and including a first distal end, the first guide arm further rotatably mountable to loader buckets or forks having different widths;

a second guide arm rotatably mountable to the loader bucket or fork and including a second distal end, the second guide arm further rotatably mountable to loader buckets or forks having different widths;

a grapple tooth bar mounting bracket attached to the first distal end and the second distal end, the grapple tooth bar mounting bracket defining an elongated channel extending from the first guide arm to the second guide arm;

a first grapple tooth bar having a first length and detachably positioned within the elongated channel, the first grapple tooth bar being replaceable with a second grapple tooth bar having a second length and detachably securable to the grapple tooth bar mounting bracket within the elongated channel.

20. The mounting device of claim 19, wherein the elongated channel laterally beyond the first guide arm and laterally beyond the second guide arm.

* * * * *